US011638862B2

(12) United States Patent
Albert

(10) Patent No.: US 11,638,862 B2
(45) Date of Patent: May 2, 2023

(54) TRAINING AID FOR SHOOTING A BASKETBALL

(71) Applicant: Samuel Albert, Akron, OH (US)

(72) Inventor: Samuel Albert, Akron, OH (US)

( * ) Notice: Subject to any disclaimer, the term of this patent is extended or adjusted under 35 U.S.C. 154(b) by 0 days.

(21) Appl. No.: 17/406,175

(22) Filed: Aug. 19, 2021

(65) Prior Publication Data

US 2022/0054917 A1 Feb. 24, 2022

Related U.S. Application Data

(60) Provisional application No. 63/069,009, filed on Aug. 22, 2020.

(51) Int. Cl.
*A63B 69/00* (2006.01)

(52) U.S. Cl.
CPC ..... *A63B 69/0071* (2013.01); *A63B 69/0059* (2013.01); *A63B 2243/0037* (2013.01)

(58) Field of Classification Search
CPC ..... A63B 69/0071; A63B 69/59
USPC ..... 473/450, 422
See application file for complete search history.

(56) References Cited

U.S. PATENT DOCUMENTS

| | | | | |
|---|---|---|---|---|
| 2,082,083 | A * | 6/1937 | Swift | A42B 1/004 273/336 |
| 3,628,794 | A * | 12/1971 | Conture | A63B 65/127 273/DIG. 18 |
| 3,868,108 | A * | 2/1975 | Kirchner | A63B 69/0071 473/450 |
| 5,275,419 | A * | 1/1994 | Kazemi | A63B 63/08 D2/882 |
| 5,413,328 | A * | 5/1995 | Glancey | A63B 63/00 473/439 |
| 6,622,309 | B1 * | 9/2003 | Edmonds | A63B 69/0071 473/450 |
| 2003/0211903 | A1 * | 11/2003 | Hanada | A63B 37/0007 473/378 |
| 2017/0333772 | A1 * | 11/2017 | Sussman | A42B 1/0182 |
| 2022/0054917 | A1 * | 2/2022 | Albert | A63B 69/0071 |

* cited by examiner

*Primary Examiner* — Mitra Aryanpour
(74) *Attorney, Agent, or Firm* — Calfee, Halter & Griswold LLP

(57) ABSTRACT

A training aid for shooting a basketball including a head-mounting portion configured to mount onto the head of a person shooting the basketball and a feedback-providing portion attached to, and supported by, the head mounting portion. The feedback-providing portion defining a forward-facing engagement surface extending upward from the head-mounting portion that provides tactile feedback to the person when the engagement surface is contacted by at least one of the basketball and a shooting hand of the person shooting the basketball.

20 Claims, 5 Drawing Sheets

TRAINING AID FOR SHOOTING A BASKETBALL

RELATED APPLICATIONS

This application also claims priority to and the benefits of U.S. Provisional Patent Application Ser. No. 63/069,009, titled "Basketball Set Point Shooting Shield," which was filed on Aug. 22, 2020 and is incorporated herein by reference in its entirety.

BACKGROUND

Shooting a basketball accurately and consistently requires proper technique and practice. When shooting a basketball (e.g., a jump shot), there is typically a loading phase and a launching phase. The loading phase refers to the motion where the shooter moves the ball, typically from in front for the shooter's waist or chest, upward above the shooter's shoulders. In the loading phase, the shooter's wrist is bent backwards (towards the posterior of the forearm) supporting the ball and the shooter's elbow is typically bent. In the launching phase, the shooter extends his/her arm upward and outward as his/her wrist moves from a bent-backward position (i.e., extension of the wrist) to a bent-forward position (i.e., flexion of the wrist) to launch the basketball at the basket. When shooting a basketball, the "set-point" refers to the location of the ball relative to the shooter's body (i.e., head, shoulders, etc.) at the point between the loading phase and the launching phase. Preferably, the position of the basketball at the set-point is approximately in front of and adjacent the shooter's forehead. A set point location that is inconsistent from shot-to-shot or above and over the shooter's head may decrease shooting accuracy and/or range.

SUMMARY

An exemplary training aid for shooting a basketball includes a head-mounting portion configured to mount onto the head of a person shooting the basketball and a feedback-providing portion attached to, and supported by, the head mounting portion. The feedback-providing portion defining a forward-facing engagement surface extending upward from the head-mounting portion that provides tactile feedback to the person when the engagement surface is contacted by at least one of the basketball and a shooting hand of the person shooting the basketball.

An exemplary method for training the technique of shooting a basketball, where the technique includes a loading phase, a launching phase, and a set-point location defining the position of the basketball between the loading phase and the launching phase. The method includes mounting an engagement surface onto a head of a person shooting a basketball where the engagement surface is adjacent the set-point location, bringing the basketball to the set-point location such that at least one of the basketball and a shooting hand of the person contacts the engagement surface, and launching the basketball.

DETAILED DESCRIPTION

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

FIGS. 1-4 illustrate an example training aid 100 for shooting a basketball 102. The training aid 100 is configured to provide feedback to a person ("shooter") 104 shooting the basketball 102 with regard to whether the basketball 102 is positioned at a desired set-point. The training aid 100 may be configured in a variety of ways. In the illustrated example, the training aid 100 includes a head-mounting portion 106 and a feedback-providing portion 108 attached to, or integrally formed with, the head-mounting portion 106. In some implementations, the head-mounting portion 106 and the feedback-providing portion 108 are formed as a single, unitary piece. In other implementations, the head-mounting portion 106 and the feedback-providing portion 108 are separate components attached together.

Figure 1:
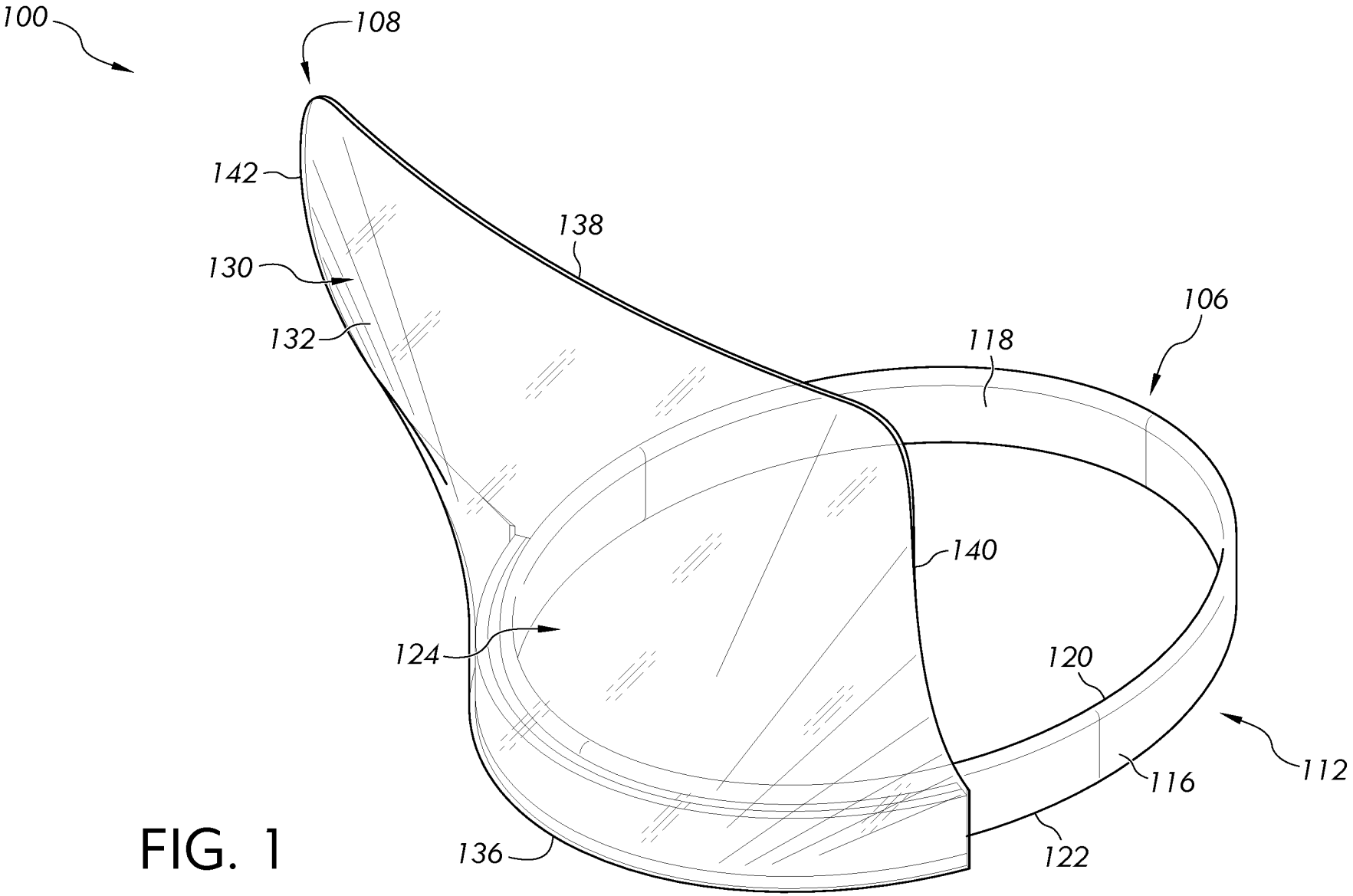
FIG. 1 illustrates a front perspective view of an example training aid for shooting a basketball.
Figure 2:
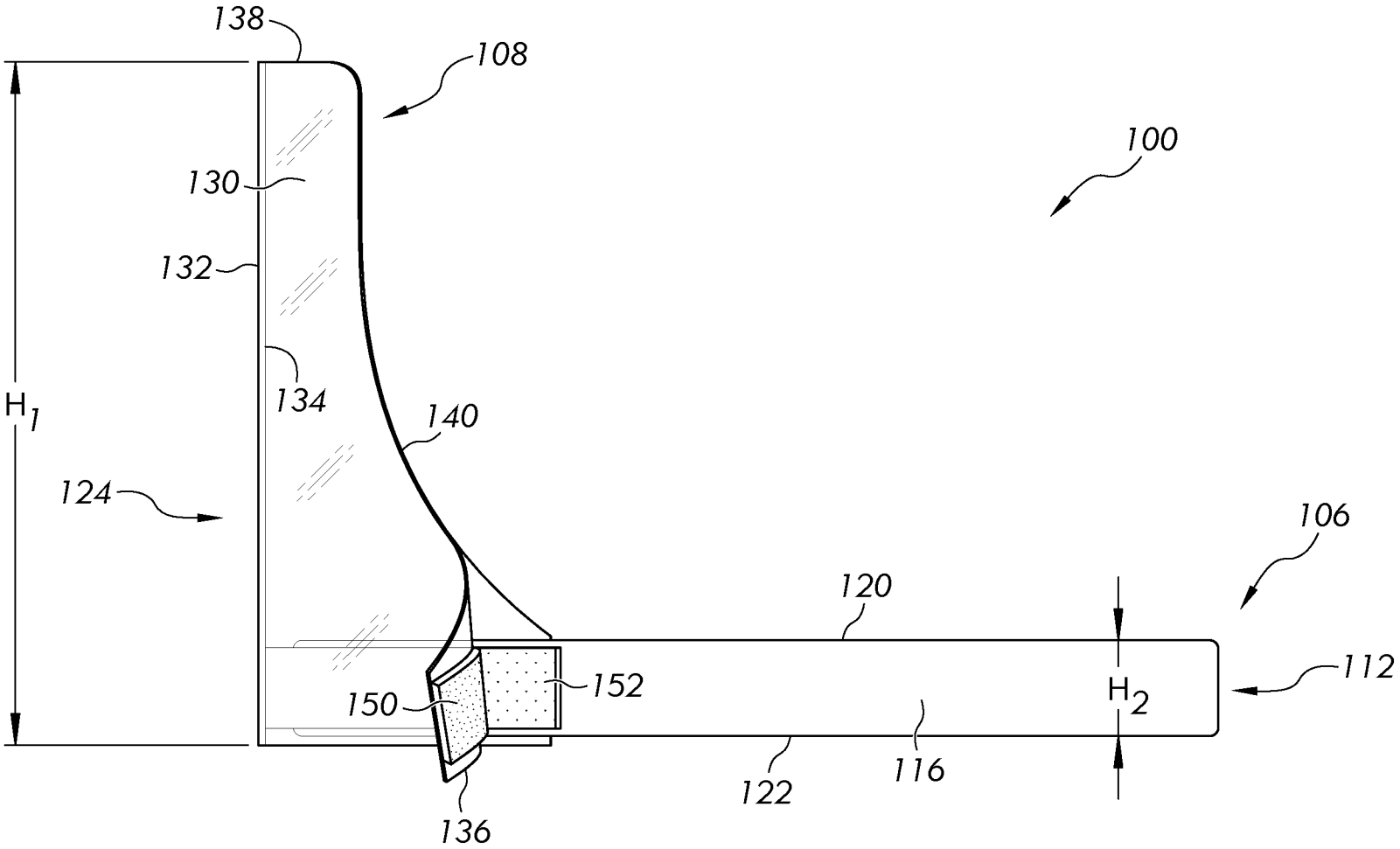
FIG. 2 illustrates a top view of the training aid of FIG. 1.
Figure 3:
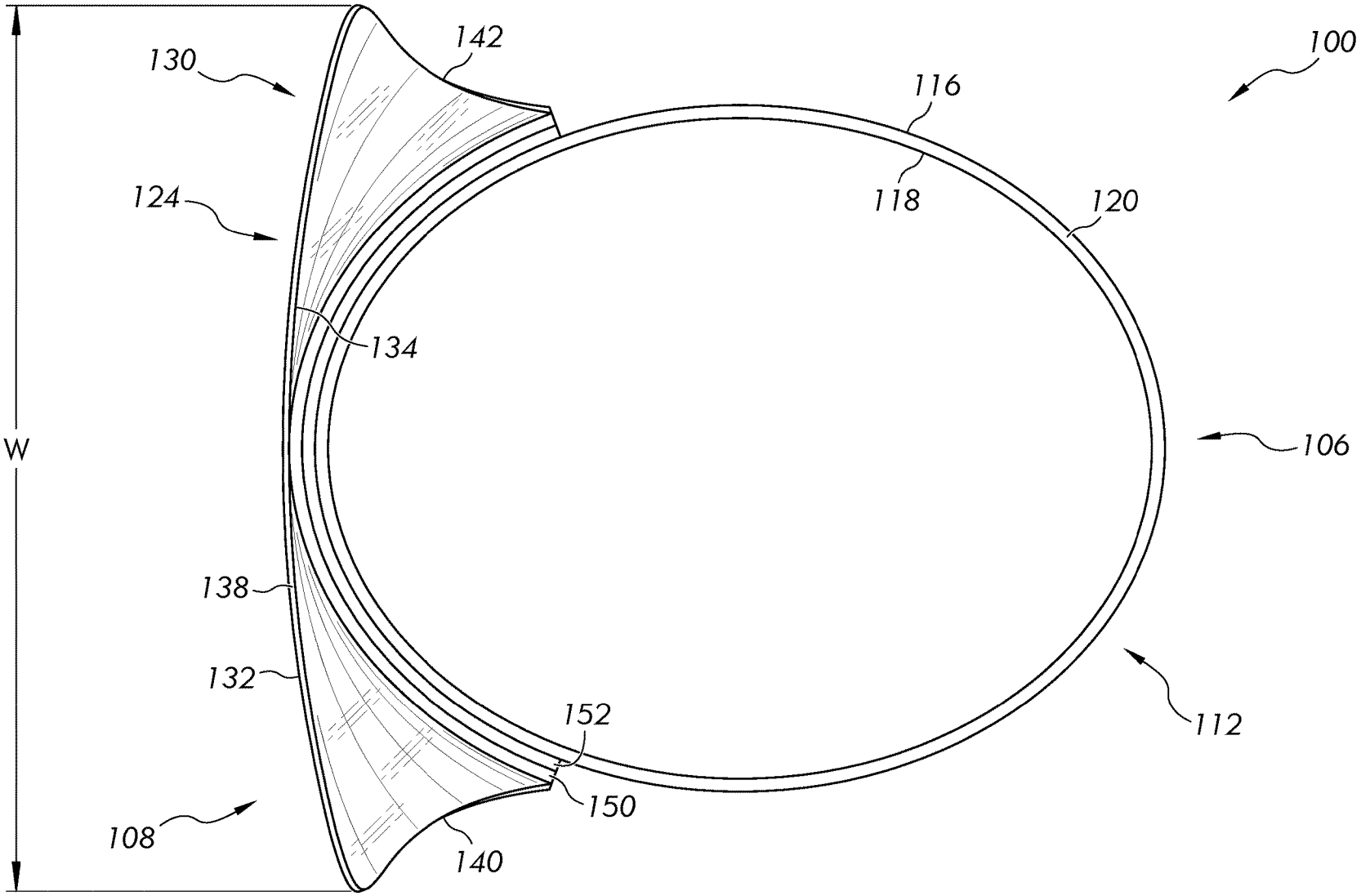
FIG. 3 illustrates a side view of the training aid of FIG. 1.
Figure 4:
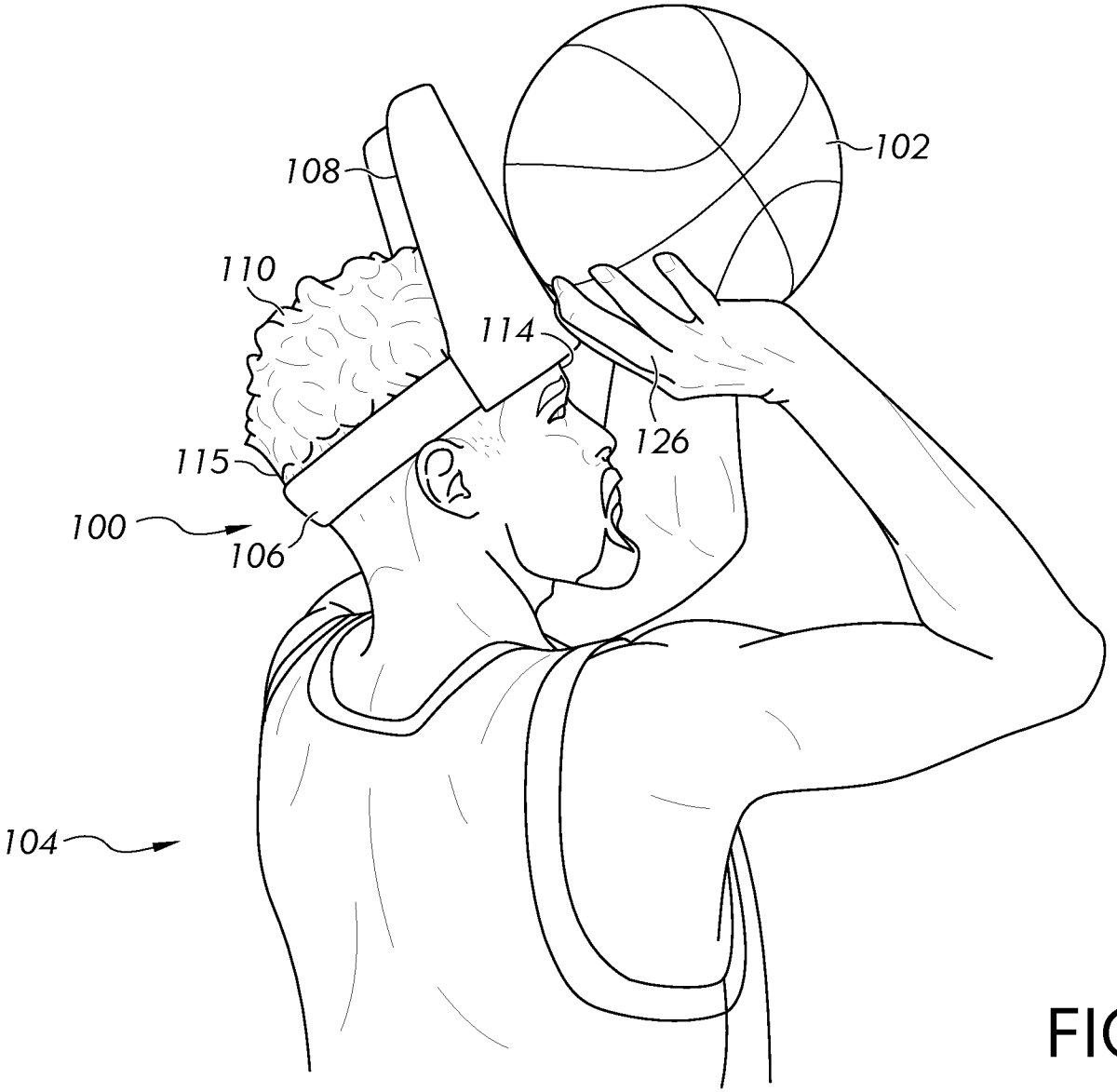
FIG. 4 illustrates the training aid of FIG. 1 worn by a user.

The head-mounting portion 106 is configured to mount onto a head 110 (FIG. 4) of the shooter 104 in order to support and position the feedback-providing portion 108. The head-mounting portion 106 may be configured in a variety of ways. Any configuration that may securely mount onto the head 110 of the shooter 104 may be used. For example, the head-mounting portion 106 may include a head band, a head strap, a head covering, a head wrap, a chin strap, or other suitable devices and combinations thereof for supporting and positioning the feedback-providing portion 108. In the illustrated example, the head-mounting portion 106 includes a head band 112 configured to encircle the head 110 of the shooter 104 in a generally horizontal arrangement (i.e., contacting a forehead 114 and the back of the head 110 of the shooter 104), as shown in FIG. 4.

The head band 112 may be configured in a variety of ways, such as different dimensions (e.g., thickness, width, circumference), shapes, materials used, and adjustment devices (i.e., ways of adjusting the size and ensuring a secure fit onto the shooter's head). For example, in some implementations, the head band 112 has a closure, similar to an adjustable baseball cap. Various known closure types may be used, such as for example, a plastic snap, double plastic snap, a hook and loop tape, a tuck strap with slide, a tuck strap with buckle or snap, a D-Fit®, or other suitable closure type. The head band 112 may be made of any suitable material or materials, such as plastic, nylon, an elastic material, such as rubber, spandex, elastane, or fold-over elastic stretch. Preferably, the materials used are lightweight and comfortable to wear, in addition to being able to support the feedback-providing portion 108 as desired.

In the illustrated example, the head band 112 is a continuous, elastic band made of any suitable elastic material. The head band 112 has an outer face 116, an inner face 118 opposite and parallel to the outer face 116, an upper edge 120 extending between the outer face 116 and the inner face 118, and a lower edge 122 opposite the upper edge 120 and extending between the outer face 116 and the inner face 118. The head band 112 may include a fabric material, such as for example, nylon, polyester, or cotton, on the inner face 118, or surrounding the entire elastic band. The fabric material is configured to be a comfortable to the touch (i.e., skin friendly). In some implementations, the head band 112 may include an elastic band (e.g., spandex) with a soft fabric cover (e.g., cotton, polyester). In some implementations, the head band 112 may be configured as a sweat band that is sweat absorbent to keep sweat from the eyes of the shooter during use. For example, the fabric cover may include a sweat absorbent material.

In the illustrated example, the head band 112 is configured to provide the necessary support for, and positioning of, the feedback-providing portion 108. In other implementations, however, additional straps, bands, head coverings, or supports may be used in conjunction with, or incorporated with, the head band 112. For example, an additional strap (not shown) may be connected to the head band 112 and extend over the head 110 of the shooter 104, perpendicular to the head band 112 (e.g., ear-to-ear). In the illustrated example, the head band 112 has a height $H_2$ in the range of 1 inch to 3 inches. In other embodiments, however, the height can be greater than 3 inches or less than 1 inch.

The feedback-providing portion 108 is configured to provide a tactile feedback to the shooter 104 when the basketball 102 is at the desired set-point or, alternatively, beyond the set-point (i.e., above and over the shooter's head more than is desired). In the illustrated example, the feedback providing portion 108 includes a forward-facing engagement surface 124 which the basketball 102 and/or a shooting hand 126 of the shooter 104 contacts to provide the tactile feedback. The feedback-providing portion 108 may be configured in a variety of ways. Any suitable configuration that can provide the aforementioned engagement surface 124 may be used. Some implementations of the training aid 100 may be worn while the shooter 104 is playing a basketball game or participating in a practice (e.g., solo practice or multi-person practice). Thus, some configurations of the training aid 100 allow for free movement of the shooter's hands, arms, and legs, do not hinder passing, catching, or dribbling the basketball 102, do not affect the shooter's vision, are light enough to not negatively affect movement of the shooter, and sturdy and durable enough to not break during rigorous activity.

In the illustrated example, the feedback-providing portion 108 is configured as a single panel 130. In other implementations, the feedback-providing portion 108 may be a plurality of panels, fingers, stems, or other components capable of providing tactile feedback. In the illustrated example, the panel 130 includes a front face 132, a rear face 134 opposite and parallel to the front face 132, a bottom edge 136 extending between the front face 132 and the rear face 134, a top edge 138 opposite the lower edge 136 and extending between the front face 132 and the rear face 134, a first lateral edge 140 extending between the bottom edge 136 and the top edge 138, and a second lateral edge 142 opposite the first lateral edge 140 and extending between the bottom edge 136 and the top edge 138. In the illustrated example, the panel 130 is generally rectangular. In other implementations, however, the panel 130 can be any suitable shape. In the illustrated embodiment, the panel 130 has a height $H_1$ and a width W. The height $H_1$ and the width W may vary in different implementations. In the illustrated embodiment, the height $H_1$ is in the range of 4 inches to 8 inches, or 5 inches to 7 inches and the width W is in the range of 2 inches to 6 inches, such as 3 inches to 5 inches. In other implementations, however, the height $H_1$ may be greater than 8 inches or less than 4 inches and the width W may be greater than 6 inches or less than 2 inches.

In the illustrated example, the front face 132 is convex and the rear face 134 is concave. In other implementations, however, the front face and/or rear face may be planar or any other suitable shape. As shown, for example, in FIGS. 1 and 3, the amount of concavity or convexity of the panel 130 may vary across the panel 130. For example, in the illustrated implementation, the portion of the panel 130 towards, or adjacent, the bottom edge 136 may be curved (i.e., concave or convex) more than the portion of the panel 130 toward, or adjacent, the top edge 138. In other embodiments, however, the concavity or convexity of the panel 130 may be equal across the panel 130 or the portion of the panel 130 towards, or adjacent, the bottom edge 136 may be curved (i.e., concave or convex) less than the portion of the panel 130 toward, or adjacent, the top edge 138. The front face 132 defines the forward-facing engagement surface 124, which may be a portion of the front face 132 or the entire front face 132.

The panel 130 may be made from any suitable material or materials, such as for example, plastic, foam, cardboard, or other suitable material with sufficient rigidity to serve as an engagement surface and light enough in weight to be non-intrusive while the shooter 104 plays or practices basketball. In some implementations, the panel 130 may be rigid such that the panel 130 does not deflect, or deflects only a small amount, when contacted by the basketball 102 and/or a shooting hand 126 during the shooting motion. In other implementations, however, the panel 130 may be flexible and resilient such that upon contact by the basketball 102 and/or the shooting hand 126, the panel 130 moves from an upright position (as shown in FIG. 4, for example) to a deflected position where the panel 130 bends or deflects backward toward a back 115 of the head 110 of the shooter 104. After the basketball 102 is launched, the panel 130, due to its resilient nature, returns to the upright position.

In some implementations, the front face 132 and the rear face 134 may be continuous (i.e., not include any holes, slits, or other openings). In other implementations, the panel 130 may include one or more holes, slits, slots, or other openings extending through the panel 130 from the front face 132 to the rear face 134. Including one or more openings in the panel 130 may be advantageous to reduce the weight and decrease air resistance of the panel 130.

The panel 130 is configured to mount to, or be integrally formed with, the head band 112 such that the panel 130 extends superiorly from the shooter's forehead 114 when the head band 112 is properly worn by the shooter 104, as shown in FIG. 4. The panel 130 may mount to the head band 112 in any suitable manner, such as for example, but not limited to, adhesives, hoop and loop strips, fasteners, snaps, clasps, clamps, or other suitable attachment devices. In the illustrated example, the panel 130 includes a hook/loop strip 150 mounted on the rear face 134 adjacent the bottom edge 136 and a corresponding loop/hook strip 152 mounted on the outer face 116 of the head band 112. The panel 130 can be readily attached or removed from the head band 112 via the corresponding hook/loop strips 150, 152.

In use, the shooter 104 places the training aid 100 onto his/her head 110 such that the head band 112 extends across his/her forehead 114 and the panel 130 extend upward from the head band 112. If necessary, the circumference of the head band 112 can be adjusted for a secure and comfortable fit onto the shooter's head 110. Once the training aid 100 is securely positioned onto the shooter's head 110, the shooter 104 can begin to shoot the basketball 102. During shooting, as the shooter 104 goes through the loading phase of the shooting technique, the basketball 102 and/or a shooting hand 126 will contact the engagement surface 124 on the panel 130 when the basketball 102 is at the desired set-point. The contact between the basketball 102 and/or a shooting hand 126 and the engagement surface 124 provides a tactile feedback to the shooter 104. Thus, the shooter 104 can be given feedback on every shot regarding when the basketball 102 is at the desired set-point. As a result, the shooter 104 can shoot the basketball 102 with correct form in a repeatable manner.

Figure 5:
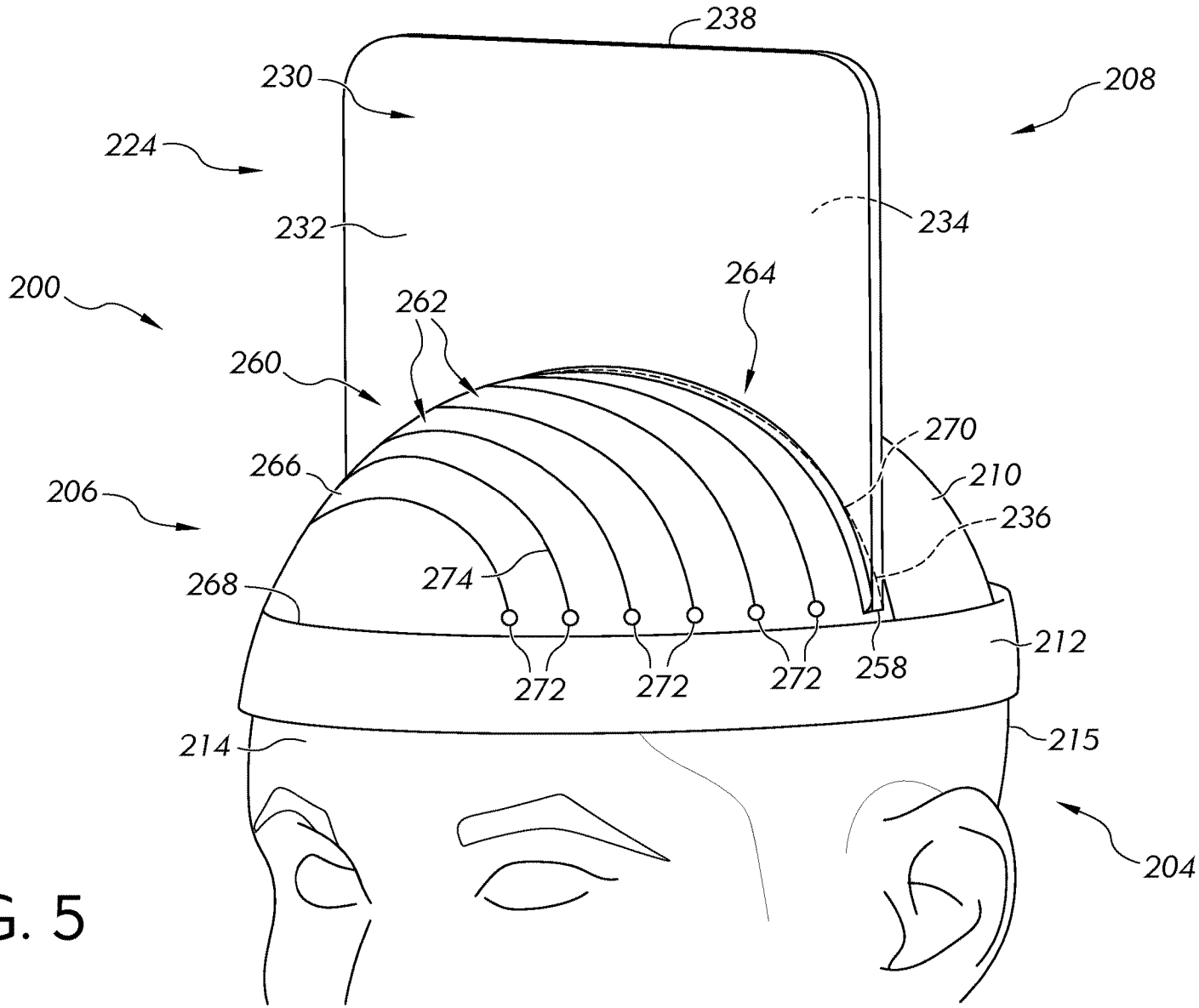
FIG. 5 illustrates side perspective view of an example training aid for shooting a basketball.

FIG. 5 illustrates another example training aid 200 for shooting a basketball (e.g., basketball 102 of FIG. 4). The training aid 200 is similar to the training aid 100 of FIGS. 1-4 in that it configured to provide feedback to a shooter 204 with regard to whether the basketball is positioned at a desired set-point during shooting. The training aid 200 may be configured in a variety of ways. In the illustrated example, the training aid 200 includes a head-mounting portion 206 and a feedback-providing portion 208 attached to the head-mounting portion 206.

The head-mounting portion 206 is configured similar to the head mounting portion 106 of FIGS. 1-4. The head mounting portion 206 is configured to mount onto a head 210 of the shooter 204 in order to support and position the feedback-providing portion 208. The head-mounting portion 206 may be configured in a variety of ways. Any configuration that may securely mount onto the head 210 of the shooter 204 may be used. For example, the head-mounting portion 206 may include a head band, a head strap, a head covering, a head wrap, a chin strap, or other suitable devices and combinations thereof for supporting and positioning the feedback-providing portion 208. In the illustrated example, the head-mounting portion 206 includes a head band 212 configured to encircle the head 210 of the shooter 204 in a generally horizontal arrangement, as shown in FIG. 4. The head band 212 may be substantially similar to the head band 112 of FIGS. 1-4.

The head band 212 may be configured in a variety of ways, such as different dimensions (e.g., thickness, width, circumference), shapes, materials used, and adjustment devices (i.e., ways of adjusting the size and ensuring a secure fit onto the shooter's head). For example, in some implementations, the head band 212 has a closure, similar to an adjustable baseball cap. Various known closure types may be used, such as for example, a plastic snap, double plastic snap, a hook and loop tape, a tuck strap with slide, a tuck strap with buckle or snap, a D-Fit®, or other suitable closure type. The head band 212 may be made of any suitable material or materials, such as plastic, nylon, an elastic material, such as rubber, spandex, elastane, or fold-over elastic stretch. Preferably, the materials used are lightweight and comfortable to wear, in addition to being able to support the feedback-providing portion 108 as desired. In the illustrated example, the head band 212 is a continuous, elastic band made of any suitable elastic material.

The head-mounting portion 206 also includes a cover portion 260. The cover portion 260 is configured to provide a plurality of mounting locations 262, relative to the head band 212, for the feedback-providing portion 208. The cover portion 260 may be configured in a variety of ways. In the illustrated implementation, the cover portion 260 is a half-dome extending from a location adjacent the forehead 214 of the shooter 204 rearward and terminating at a midpoint 264 between the forehead 214 and the back 215 of the head 210 of the shooter 204. The cover portion 260 is configured to generally conform to the shape of the head 210 of the shooter 204. The cover portion 260 includes a convex outer surface 266, a concave inner surface (not shown) opposite the outer surface 266, an exterior edge 268 between the inner surface (not shown) and outer surface 266, and a rear edge 270 between the inner surface (not shown) and outer surface 266. The rear edge 270 is curved to generally conform to the shape of the head 210 of the shooter 204.

The cover portion 260 is connected to, or integrally formed with, the head band 212. The cover portion 260 may be connected to the head band 212 in any suitable manner. In the illustrated example, the exterior edge 268 is connected to the head band 212 by, for example, hook and loop fastening strips (not shown). The plurality of mounting locations 262 for mounting the feedback-providing portion 208 may be configured in a variety of ways. Any configuration that allows the feedback-providing portion 208 to mount to different locations on the cover portion 260 relative to the head band 212 may be used. In the illustrated example, each of the plurality of mounting locations 262 includes a pair of fasteners 272, one on each side of the head 210, and a groove 274 extending between the pair of fasteners 272. The mounting locations 262 are arranged in series such that the feedback-providing portion 208 may be moved forward and backward as desired. Thus, as shown in FIG. 5, each groove 274 extends parallel to the other grooves 274 and each fastener 272 on each side is aligned with the other snap fasteners 272 on that side. The fasteners 272 may be configured in a variety of ways. In one exemplary implementation, the fasteners are a male or female snap fastener.

The feedback-providing portion 208 is configured to provide a tactile feedback to the shooter 204 when the basketball is at the desired set-point or, alternatively, beyond the set-point (i.e., above and over the shooter's head more than is desired). In the illustrated example, the feed-back providing portion 208 includes an engagement surface 224 which the basketball and/or a shooting hand 126 of the shooter 204 contacts to provide the tactile feedback. The feedback-providing portion 208 may be configured in a variety of ways. Any suitable configuration that can provide the aforementioned engagement surface 224 may be used.

In the illustrated example, the feedback-providing portion 208 is configured as a single panel 230. In other implementations, the feedback-providing portion 208 may be a plurality of panels, fingers, stems, or other components capable of providing tactile feedback. In the illustrated example, the panel 230 includes a front face 232, a rear face 234 opposite and parallel to the front face 232, a bottom edge 236 extending between the front face 232 and the rear face 234, a top edge 238 opposite the lower edge 236 and extending between the front face 232 and the rear face 234, a first lateral edge 240 extending between the bottom edge 236 and the top edge 238, and a second lateral edge 242 opposite the first lateral edge 240 and extending between the bottom edge 236 and the top edge 238. In the illustrated example, the panel 230 is generally rectangular, but the bottom edge 236 is concave to conform to the shape of the convex outer surface 266 of the cover portion 260. In other implementations, however, the panel 230 can be any suitable shape.

In the illustrated example, the front face 232 and the rear face 234 are planar. In other implementations, however, the front face and/or rear face may convex and concave, respectively, or any other suitable shape. The front face 232 defines the engagement surface 224, which may be a portion of the front face 232 or the entire front face 232.

The panel 230 may be made from any suitable material or materials, such as for example, plastic, foam, cardboard, or other suitable material with sufficient rigidity to serve as an engagement surface and light enough in weight to be non-intrusive while the shooter 204 plays or practices basketball. In some implementations, the front face 232 and the rear face 234 may be continuous (i.e., not include any holes, slits, or other openings). In other implementations, the panel 230 may include one or more holes, slits, slots, or other openings extending through the panel 230 from the front face 232 to the rear face 234. Including one or more openings in the panel 230 may be advantageous to reduce the weight and decrease air resistance of the panel 230.

The panel 230 is configured to mount to the cover portion 260 such that the panel 230 extends superiorly from the shooter's forehead 214 when the head band 212 is properly worn by the shooter 204, as shown in FIG. 5. The panel 230 may mount to the cover portion 260 in any suitable manner. In the illustrated example, the panel 230 includes a pair of fasteners (not shown) mounted on the bottom edge 236 and configured to connect to a corresponding pair of fasteners 272 on the cover portion 260. For example, the pair of fasteners knot shown) may be a female or male snap fasteners configured to connect to the corresponding male or female snap fastener 272 on the cover portion 260. In addition, the bottom edge 236 is configured to be received within one of the grooves 274 in the cover portion 260. In this way, most, or all, of the bottom edge 236 is supported by the cover portion 260 via one of the grooves 274 and the pair of fasteners.

The panel 230 can be readily attached or removed from the cover portion 260 via the fasteners and adjusted in a forward or backward direction to change the location where the basketball will contact the panel 230. Thus, the shooter can adjust the set-point of his/her shot to find the position that is best for him/her.

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A training aid for shooting a basketball, comprising:

a head-mounting portion configured to mount onto a head of a person shooting the basketball;

a feedback-providing panel attached to, supported by, and extending upward from the head mounting portion, the feedback-providing panel having a front major face, a rear major face opposite the front major face, a top minor edge extending between the front major face and the rear major face, and a bottom minor edge opposite the top minor edge and extending between the front major face and the rear major face, the front major face defining a forward-facing engagement surface that provides tactile feedback to the person when the engagement surface is contacted by at least one of the basketball and a shooting hand of the person shooting the basketball, wherein the front major face extends across a majority of a forehead of the person when the head-mounting portion is mounted onto the head of the person.

2. The training aid of claim 1, wherein the head mounting portion includes a head band configured to encircle a head of the person shooting the basketball.

3. The training aid of claim 2, wherein the head band has a circumference that is adjustable.

4. The training aid of claim 2, wherein the head band is continuous and includes an elastic material.

5. The training aid of claim 2, wherein the head band in non-continuous and includes a closure.

6. The training aid of claim 1, wherein the front major face is convex.

7. The training aid of claim 1, wherein the panel is attached to the head band at a location on the rear major face adjacent the bottom edge.

8. The training aid of claim 1, wherein the position of the panel on the head band is adjustable in a forward and a backward direction.

9. The training aid of claim 1, wherein the panel is attached to the headband by an adhesive, snaps, or a hook and loop fastener.

10. The training aid of claim 1, wherein the feedback-providing portion is made from at least one of a rigid foam and a plastic.

11. A training aid for shooting a basketball, comprising:

a head-mounting portion configured to mount onto a head of a person shooting the basketball;

a feedback-providing panel attached to, supported by, and extending upward from the head mounting portion, the feedback-providing panel having a front major face, a rear major face opposite the front major face, a top minor edge extending between the front major face and the rear major face, and a bottom minor edge opposite the top minor edge and extending between the front major face and the rear major face, the front major face defining a forward-facing engagement surface that provides tactile feedback to the person when the engagement surface is contacted by at least one of the basketball and a shooting hand of the person shooting the basketball, wherein when the head-mounting portion is mounted onto the head, the front major face is positioned to provide tactile feedback when the person reaches a set-point with the basketball that is in front of and adjacent a forehead of the person.

12. The training aid of claim 11, wherein the head mounting portion includes a head band configured to encircle a head of the person shooting the basketball.

13. The training aid of claim 12, wherein the head band has a circumference that is adjustable.

14. The training aid of claim 12, wherein the head band is continuous and includes an elastic material.

15. The training aid of claim 12, wherein the head band in non-continuous and includes a closure.

16. The training aid of claim 11, wherein the front major face is convex.

17. The training aid of claim 11, wherein the panel is attached to the head band at a location on the rear major face adjacent the bottom edge.

18. The training aid of claim 11, wherein the front major face has a height in the range of 4 inches to 8 inches and a width in the range of 2 inches to 6 inches.

19. The training aid of claim 11, wherein the position of the panel on the head band is adjustable in a forward and a backward direction.

20. The training aid of claim 11, wherein the feedback-providing portion is made from at least one of a rigid foam and a plastic.

* * * * *